US012139998B2

(12) United States Patent
Guest

(10) Patent No.: US 12,139,998 B2
(45) Date of Patent: Nov. 12, 2024

(54) DOWNHOLE CONTROL ARRANGEMENT, VALVE ARRANGEMENT, SIDE POCKET MANDREL, AND METHOD FOR OPERATING A DOWNHOLE VALVE ARRANGEMENT

(71) Applicant: PETROLEUM TECHNOLOGY COMPANY AS, Stavanger (NO)

(72) Inventor: Oliver Guest, Ræge (NO)

(73) Assignee: PETROLEUM TECHNOLOGY COMPANY AS, Stavanger (NO)

( * ) Notice: Subject to any disclaimer, the term of this patent is extended or adjusted under 35 U.S.C. 154(b) by 0 days.

(21) Appl. No.: 17/796,202

(22) PCT Filed: Jan. 29, 2021

(86) PCT No.: PCT/NO2021/050028

§ 371 (c)(1),
(2) Date: Jul. 28, 2022

(87) PCT Pub. No.: WO2021/154091

PCT Pub. Date: Aug. 5, 2021

(65) Prior Publication Data

US 2023/0116200 A1 Apr. 13, 2023

(30) Foreign Application Priority Data

Jan. 31, 2020 (NO) ..... 20200124

(51) Int. Cl.
*E21B 34/06* (2006.01)
*E21B 41/00* (2006.01)
*E21B 43/12* (2006.01)

(52) U.S. Cl.
CPC ..... *E21B 34/066* (2013.01); *E21B 41/0085* (2013.01); *E21B 43/1235* (2020.05)

(58) Field of Classification Search
CPC .. E21B 43/1235; E21B 43/123; E21B 43/122; E21B 34/066; E21B 4/0085; E21B 17/0283
See application file for complete search history.

(56) References Cited

U.S. PATENT DOCUMENTS 5,207,272 A * 5/1993 Pringle ..... E21B 43/123 166/120
5,535,828 A * 7/1996 der Kinderen ..... E21B 43/123 166/241.5

(Continued)

FOREIGN PATENT DOCUMENTS

GB 2264137 A 8/1993
WO 9522682 A1 8/1995

(Continued)

OTHER PUBLICATIONS

International Search Report corresponding to related International Application No. PCT/NO2021/050028, mailed May 10, 2021, 4 pages.

(Continued)

*Primary Examiner* — George S Gray
(74) *Attorney, Agent, or Firm* — K&L Gates LLP

(57) ABSTRACT

A downhole control arrangement for installation in hydrocarbon well and for controlling the operation of a downhole valve arrangement comprises an electrically controlled control valve, wherein the control arrangement comprises a control system and an electric power supply source configured for supplying electric power to the control system. A downhole valve arrangement for controlling the flow of an injection fluid into a production tubing of a hydrocarbon well comprises a control arrangement, and a side pocket mandrel for installation in a production tubing for use in a (Continued)

hydrocarbon well, wherein the side pocket mandrel comprises an interior pocket space and a valve arrangement.

7 Claims, 6 Drawing Sheets

(56) References Cited

U.S. PATENT DOCUMENTS

| | | | | |
|---|---|---|---|---|
| 5,887,657 | A | 3/1999 | Bussear et al. | |
| 5,896,924 | A * | 4/1999 | Carmody | E21B 34/066 166/69 |
| 2018/0149002 | A1 * | 5/2018 | Murdoch | E21B 44/005 |
| 2020/0256144 | A1 * | 8/2020 | Deville | E21B 47/01 |

FOREIGN PATENT DOCUMENTS

| | | | |
|---|---|---|---|
| WO | 2016181154 | A1 | 11/2016 |
| WO | 2019089882 | A1 | 5/2019 |

OTHER PUBLICATIONS

International Written Opinion corresponding to related International Patent Application No. PCT/NO2021/050028, mailed May 10, 2021, 5 pages.

Norwegian Search Report corresponding to related Norwegian Application No. 2020124, Report dated Aug. 26, 2020, 2 pages.

* cited by examiner

DOWNHOLE CONTROL ARRANGEMENT, VALVE ARRANGEMENT, SIDE POCKET MANDREL, AND METHOD FOR OPERATING A DOWNHOLE VALVE ARRANGEMENT

CROSS REFERENCE TO RELATED APPLICATIONS

The present application is a National Stage of International Application No. PCT/NO2021/050028, filed on Jan. 29, 2021, which claims priority to Norwegian patent application Ser. No. 20/200,124, filed on Jan. 31, 2020, the entire contents of each of which are being incorporated herein by reference.

TECHNICAL FIELD

The disclosure relates to a downhole control arrangement for installation in hydrocarbon well and for controlling the operation of a downhole valve arrangement. It also relates to a downhole valve arrangement for controlling the flow of an injection fluid into a production tubing of a hydrocarbon well and comprising a downhole control arrangement. It further relates to a side pocket mandrel comprising a valve arrangement, to a method for operating a downhole valve arrangement and to a method for supplying electric power to a downhole valve arrangement.

BACKGROUND

To improve the production from petroleum wells, gas lift operations are commonly applied. In such operations, valves are used to allow gas to flow from the annulus, located between the casing and the tubing, into the tubing. The gas lift valves (GLV) are housed in the valve pocket of a side pocket mandrel (SPM) being part of the tubing. These valves are passive, self-regulating, e.g. by means of a physical spring, or by an internal gas charge. It is often the case that several valves are located at different depths in the well, and are designed to open and close at specific pressures. These pressures are defined by the strength of the spring, or the magnitude of the pressure in the internal gas charge. This method is limited, as the pressures that each valve opens at is fixed once they are installed. In order to change the opening pressures of the valves, they may be retrieved from the well and either modified or replaced with a different valve. This is time consuming and expensive.

In addition, there is no way to confirm directly if a valve is open or closed. It can be implied by monitoring the pressures at surface, but in a complex well setup, it may be difficult to know with any certainty the status of a specific valve. Especially if one of the valves is damaged, or malfunctioning, or if there are other problems in the well such as tubing or casing leaks. Thus, obtaining reliable feedback from a downhole device in a production tubing is also a known problem, and often it requires comprehensive modifications of the well and the production tubing.

There is therefore a need in the field for devices and methods to enable improved control, monitoring and communication to a downhole device and/or from a downhole device to a topside controller, without adding significant complexity and cost to a project.

SUMMARY

An objective of the present disclosure is to contribute to the improvement of downhole device in view of the above mentioned problems.

According to one example is provided a downhole control arrangement for installation in hydrocarbon well and for controlling the operation of a downhole valve arrangement comprising an electrically controlled control valve, wherein the control arrangement comprises a control system and an electric power supply source configured for supplying electric power to the control system. By having an electrically controlled valve arrangement is obtained the advantage of improved possibilities for control of the valve arrangement from surface level.

According to one example, the electric power supply source comprises a downhole induction coil arrangement. By using an induction coil arrangement as power source is obtained the possibility of wireless power transfer and the possibility to send a superimposed signal which may contain, data, commands, etc., both from the surface down to the valve arrangement and vice versa. It will e.g. be possible to obtain information about the status of the valve. The induction coil arrangement can supply electric power to the control system by wireless power transfer. By varying the frequency or amplitude of an alternating current that is fed to the induction coils, a digital signal can be superimposed on top of the power signal.

According to one example, the induction coil arrangement may be configured for transmitting signals from a topside controller to the control system and vice versa.

According to one example, the control system may comprise a control unit and an actuator, wherein the induction coil arrangement is configured for transmitting signals from the topside controller to the control unit and vice versa, wherein the control unit is configured to send signals to the actuator, and the actuator is configured to move a control valve of the valve arrangement between an open position and a closed position based on said signals. By this, the opening or closing a valve of the valve arrangement can be controlled. The actuator may e.g. comprise a motor, a gearbox, a solenoid or other electrically powered actuator that can move a valve member to open the control valve, in most cases mechanically.

According to one example, the actuator may be configured to send signals to the control unit with information about the open/closed status of the control valve. The control unit will then know if the actuator has performed its task, and the control unit may send the status information to a top side controller.

According to one example, the control system may comprise a sensor configured to determine the open/closed status of the control valve and to send information about the status to the control unit. The sensor may e.g. be a position sensor for the control valve or a pressure sensor that registers the pressure inside the control valve. The use of a sensor may be an alternative to having feedback directly from the actuator.

According to one example, the induction coil arrangement may be configured for supplying electric power from the topside controller to the actuator. The power to the actuator is thus provided directly from the induction coil arrangement.

According to one example, the downhole control arrangement may comprise an electric power storage device connected to the induction coil arrangement, and the electric power storage device is connected to supply electric power to actuator. In order to ensure that there is sufficient power for the actuator to operate, it is and advantage to have an electric power storage device connected to the actuator. Examples of electric storage devices are a battery, a capacitor.

According to one example, the electric power storage device may be a chargeable device that is chargeable by means of transmitting electric power from the induction coil arrangement. The power storage device can thus be recharged when required.

According to one example, the induction coil arrangement may comprise a first induction coil electrically connectable to a topside controller, located externally of the well, and a second induction coil connected to the control system.

According to another example is defined a downhole valve arrangement for controlling the flow of an injection fluid into a production tubing of a hydrocarbon well, comprising:

a valve housing having an interior space and with at least one flow inlet for infeed of injection fluid, and at least one flow outlet for delivering injection fluid to the well tubing, an electrically controlled control valve is located in the housing, and the control valve being configured to open or close a fluid communication path between the inlet and the outlet, a downhole control arrangement which controls the operation of the downhole valve arrangement including the opening and closing of the control valve.

It is an advantage to use the downhole control arrangement in combination with a valve arrangement for controlling injection fluid in a well tubing such that an improved control and improved feedback for such valve arrangements can be obtained. Thereby some of the previously mentioned problems with this type of equipment may be reduced.

According to another example is disclosed a side pocket mandrel for installation in a production tubing for use in a hydrocarbon well, wherein the side pocket mandrel comprises an interior pocket space and a valve arrangement located in the pocket space for controlling the flow of an injection fluid from an external injection fluid source into the production tubing, characterised in that the side pocket mandrel comprises an induction coil arrangement connected to a topside controller and connected to the valve arrangement for transmission of signals from the topside controller to the valve arrangement or vice versa and/or for transfer of electric power from topside controller to the valve arrangement. With reference to the previously discussed drawbacks related to valves in side pocket mandrels in well tubing, many of these drawbacks may be remedied by being able to establish a communication path between the topside controller and the valve arrangement in the mandrel. It is an additional advantage that electric power can also, or alternatively, be transferred to operate the valve arrangement.

According to one example of a side pocket mandrel, the induction coil arrangement may comprise a first induction coil located at least partly along an interior wall part of the pocket space and a second induction coil located along an exterior part of the valve arrangement, and the second induction coil is located inside the first induction coil in a concentric manner. This design has many advantages. It makes it possible to have the outer induction coil installed in the pocket space and the inner induction coil can then be pre-mounted on the valve 20 arrangement at surface level. The inner induction coil may even be provided as an integral part of the valve arrangement. Initially, the valve arrangement with the inner induction coil will be mounted in the mandrel already at surface level. However, the particular design also makes it possible for the valve arrangement to be retrievable from downhole, e.g. if it is damaged. It will also be possible to replace it inserting another valve arrangement into side pocket mandrel.

According to one example of a side pocket mandrel, it may comprise a recess provided in an external wall part of the first side wall, and the recess reaches down into the first compartment, and the recess is configured to receive the first induction coil of the induction coil arrangement for insertion into the first compartment. This will facilitate the mounting of the induction coil in the mandrel wall.

According to one example of a side pocket mandrel, it may comprise a lid configured to cover the recess. This lid will protect the induction coil from whatever is present in the surrounding annulus. It is particularly advantageous if the annulus is used for injection of pressure fluid, such as pressurized gas, into the tubing, by means of the valve arrangement.

According to one example of a side pocket mandrel, it may comprise a first seal member located between an internal wall of the pocket space and the valve arrangement at a first location and a second seal member located between the internal wall of the pocket space and the valve arrangement at a second location, whereby a first compartment is obtained in the pocket space between the first seal member and the second seal member. The seal members may advantageously be mounted onto the valve arrangement before inserting the valve arrangement into the pocket space of the side pocket mandrel.

According to one example of a side pocket mandrel, the induction coil arrangement is located in the first compartment.

By the location of the induction coil in the first compartment between the seal members is obtained that there is no pressure differential between annulus and the interior of the pocket space and the valve arrangement. The benefit of no pressure differential is particularly valid for gas lift valves, as the gas flows from the annulus into the tubing through ports.

According to one example of a side pocket mandrel, it may comprise an inlet port for injection fluid provided in a first side wall of the side pocket mandrel, which first side wall is located between the first seal member and the second seal member, wherein the inlet port is connectable to the external injection fluid source, and wherein the valve arrangement comprises a flow inlet located in the first compartment, an outlet port for injection fluid provided in a second side wall of the side pocket mandrel, which second side wall is located in a second compartment of the pocket space, which second compartment is separated from the first compartment by one of the seal members, which outlet port connects the second compartment with the well tubing, and wherein the valve arrangement comprises a flow outlet located in the second compartment.

According to one example of a side pocket mandrel, the valve arrangement may comprise a valve arrangement as defined in any one of the claims defining a valve arrangement, wherein the induction coil arrangement is connected to the valve arrangement via the control system.

According to one example is disclosed a side pocket mandrel (1) for installation in a production tubing of a hydrocarbon well, wherein the side pocket mandrel comprises an interior pocket space and a valve arrangement as defined in a claim related to a valve arrangement, located in the pocket space for controlling the flow of an injection fluid from an external injection fluid source into the production tubing.

According to another example is disclosed a method for operating a downhole valve arrangement, installed in a side pocket mandrel forming part of a production tubing of a hydrocarbon well, the valve arrangement comprising an electrically controlled control valve for controlling the flow of an injection fluid from an external injection fluid source into the production tubing, and wherein the valve arrangement is connectable to a downhole control arrangement comprising an induction coil arrangement comprising two induction coils, comprising steps of

- sending a signal from a topside controller, via cabling provided in the annulus, to a first induction coil functioning as a transmitter coil,
- transfer of signal by induction to the second induction coil functioning as a receiver coil,
- transmission of signal via cabling to a control unit,
- sending a signal from the control unit to an actuator to open the control valve, or alternatively to close the valve.

According to one example, the method may comprise sending a valve status signal from the actuator to the control unit confirming that the control valve is open alternatively closed, or using a sensor to check if the control valve is open or closed and send a valve status signal to the control unit, further comprising

- sending the valve status signal from the control unit to the second induction coil now functioning as a transmitter coil,
- transfer of valve status signal by induction to the first induction coil now functioning as a receiver coil,
- transmission of the valve status signal via cabling to topside controller.

According to yet another example is disclosed a method for supplying electric power to a downhole valve arrangement, installed in a side pocket mandrel forming part of a production tubing of a hydrocarbon well, the valve arrangement comprising an electrically controlled control valve for controlling the flow of an injection fluid from an external injection fluid source into the production tubing, and wherein the valve arrangement is connectable to a downhole control arrangement comprising an induction coil arrangement comprising two induction coils, comprising steps of

- transmitting electric power from a topside controller connected to an electric power source, via cabling provided in the annulus, to a first induction coil functioning as a transmitter coil,
- transfer of electric power by induction to the second induction coil functioning as a receiver coil,
- transmission of electric power via cabling to a control unit that controls an actuator to open the control valve, or alternatively to close the valve.

According to one example, the method may optionally comprise using the electric power to charge a power storage device that supplies electric power to the actuator.

The two described methods may be combined.

By downhole is intended that the device in question is located down in a production tubing.

The above described may be applied to different types of valves arrangements, e.g. gas lift valves, valves for chemical injection.

The disclosed side pocket mandrel may be used at several locations in the same well. There may be several side pocket mandrels at various depths in the well, each with its own induction coils and valve arrangement. Each system can be opened and closed independently. Each system may have its own dedicated cable connecting it with a topside controller, but it is also possible that each system will share one cable.

Further features and advantages of the present disclosure will also become apparent from the following detailed description of embodiments.

BRIEF DESCRIPTION OF THE DRAWINGS

The present disclosure will now be described in more detail, with reference being made to the enclosed schematic drawings illustrating different aspects and embodiments of the present disclosure, given as examples only, and in which.

Elements that are the same or represent corresponding or equivalent elements have been given the same reference numbers in the different figures.

DETAILED DESCRIPTION

Figure 1:
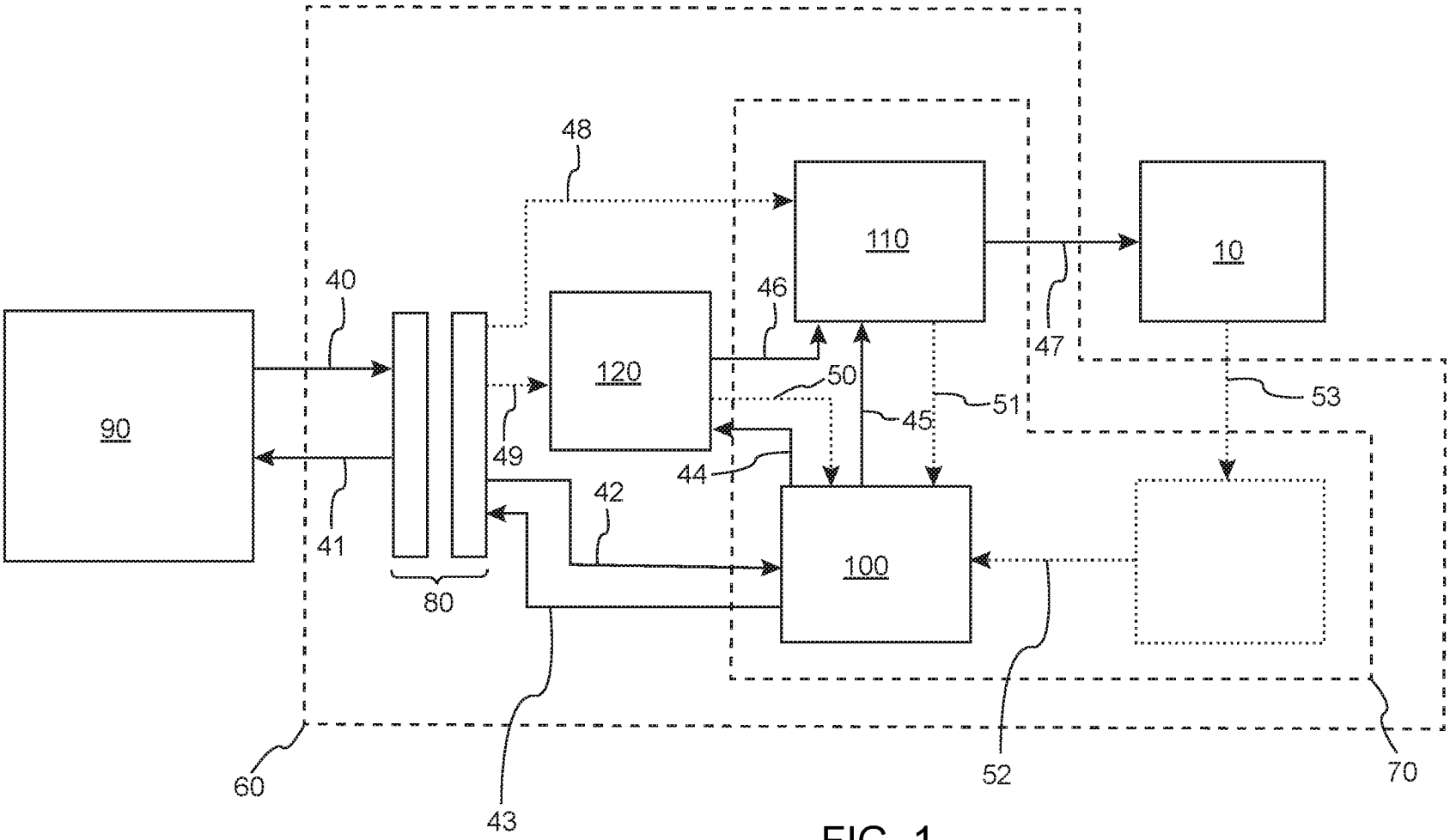
FIG. 1 is a diagram showing a downhole control arrangement.

In FIG. 1 is shown an example of a downhole control arrangement 60 for installation in a hydrocarbon well and for controlling the operation of a downhole valve arrangement 10 comprising an electrically controlled control valve. As an example, the downhole valve arrangement 10 may be such as the one shown in FIG. 2, but also other types of valve arrangements are possible. The control arrangement 60 comprises a control system 70 and an electric power supply source configured for supplying electric power to the control system 70.

In the illustrated example, the electric power supply source comprises a downhole induction coil arrangement 80. The induction coil arrangement is connected to an external electric power supply and can supply electric power to the control system 70 by wireless power transfer. By varying the frequency or amplitude of an alternating current that is fed to the induction coils, a digital signal can be superimposed on top of the power signal. In FIG. 1, the lines with the arrows indicate that power is transferred or signals are transferred or both power and a signal are transferred. Arrows with dotted lines indicate optional variations. The transfer may be by cabling or possible other means. Transfer across the induction coils will be by induction. Transfer from the actuator to the valve arrangement will be by mechanical connection. In the cases where there are two lines between two components, e.g. 40, 41 and 42, 43, with arrows in opposing directions, this indicates that signals/power can be transferred in both directions. However, in reality there could be one cable. In some examples, it would be possible to have additional signal connections than the ones illustrated, e.g. signals could be sent in any direction where there exists electric connection. By means of the induction arrangement can thus be communicated different data, commands, etc.

The induction coil arrangement 80 may be configured for transmitting signals from a topside controller 90 to the control system 70 and vice versa. The topside controller would be connected to an electric power supply. The top side controller 90 could be any type of control apparatus that is arranged above ground. It could be manually operated e.g. by a person pressing a button to open or close the valve or perform other operations, or it could be automatic. The top side controller may e.g. also contain a display device that can indicate e.g. the open or closed status of the valve, the status of a power storage device that is also part of the control arrangement, or other information that may be obtained.

In the illustrated example, the control system comprises a control unit 100 and an actuator 110. The induction coil arrangement 80 is configured for transmitting signals 40, 42; 41, 43 from the topside controller 90 to the control unit and vice versa, wherein the control unit is configured to send signals 45 to the actuator, and the actuator is configured to mechanically move 47 a control valve of the valve arrangement 10 between an open position and a closed position based on said signals. The actuator can comprise e.g. a motor, a gearbox, a solenoid or other electrically powered actuator that can move a valve member to open the control valve. The actuator may be powered directly from the induction coil arrangement, but usually it would be powered from the power storage device 120. The actuator can alternatively be regarded as being part of the valve arrangement, e.g. as an electrically controlled valve, but in the present context it is described as being part of the control system.

The actuator 110 may be configured to send signals 51 to the control unit 100 with information about the open/closed status of the control valve.

As an option, the control system 70 may comprise a sensor 130 configured to obtain 53 information and determine the open/closed status of the control valve and to send information 52 about the status to the control unit 100. The sensor may e.g. be a position sensor for the control valve or a pressure sensor that registers the pressure inside the control valve.

The induction coil arrangement 80 may also be configured for supplying electric power from the topside controller 90 to the actuator 110. This may e.g. be done by supplying power by cabling 48 directly from the induction coil arrangement 80 to the actuator. According to an alternative, there may be provided an electric power storage device 120 connected 49 to the induction coil arrangement 80, and the electric power storage device is connected 46 to supply electric power to the actuator. The electric power storage device 120 may be a chargeable device that is chargeable by means of transmitting 49 electric power from the induction coil arrangement. It may e.g. comprise a battery or a capacitor. According to another alternative, the electric power storage device is chargeable via the control unit 100, which receives 42 electric power from the induction coil arrangement and is configured to transmit 44 the electric power to the power storage device. There may also be provisions for the power storage device 120 to send 50 information to the control unit about the charge status and for the control unit to obtain such information and send it to the topside controller.

The induction coil arrangement 80 comprises a first induction coil 81 electrically connectable to a topside controller 90, located externally of the well, and a second induction coil 82 connected to the control system 70. The second induction coil is also optionally electrically connected to the actuator 110 and/or the power storage device 120. Depending on the direction of the signal, the first induction coil functions as a transmitter and the second induction coil functions as a receiver, or vice versa.

Figure 3:
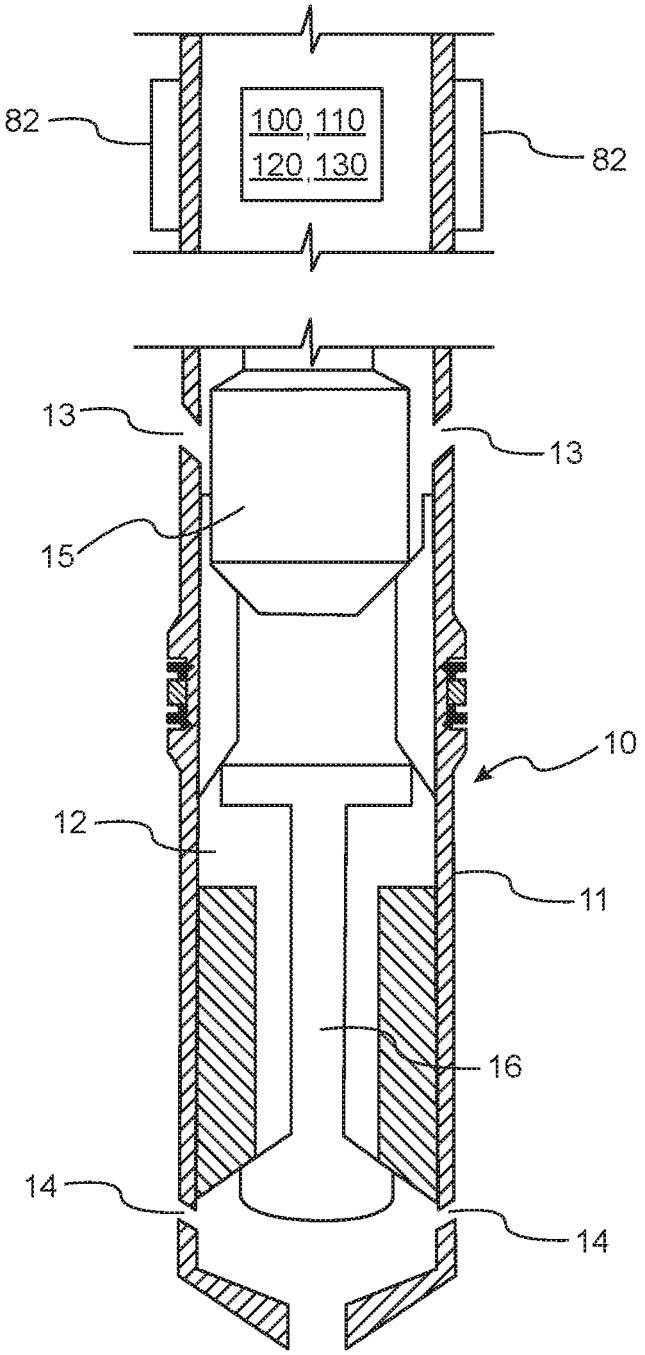
FIG. 3 shows an example of a valve arrangement.

In FIG. 3 is shown a schematic example of a downhole valve arrangement 10 for controlling the flow of an injection fluid into a production tubing of a hydrocarbon well. The valve arrangement comprises a valve housing 11 having an interior space 12 and with at least one flow inlet 13 for infeed of injection fluid, and at least one flow outlet 14 for delivering injection fluid to the well tubing. It also comprises an electrically controlled control valve 15 located in the housing, and the control valve is configured to open or close a fluid communication path between the inlet 13 and the outlet 14. The valve arrangement further comprises a downhole control arrangement 60 as described above, which controls the operation of the downhole valve arrangement 10 including the opening and closing of the control valve 15. However only the induction coil 82 closest to the valve arrangement is shown in FIG. 3. The actuator of the control device would thus work to move the control valve such that injection fluid fed via the inlets 13 will enter into the interior space 12 of the valve housing. In the illustrated example there is also a check valve 16 arranged between the control valve and the outlet 14. This check valve will prevent backflow from the tubing into the valve housing. It is optional. When the control valve opens and fluid enters the interior space of the valve arrangement, the check valve will automatically move down and free the outlets 14 such that a free fluid communication path will exist between the inlet 13 and the outlet 14.

Figure 2:
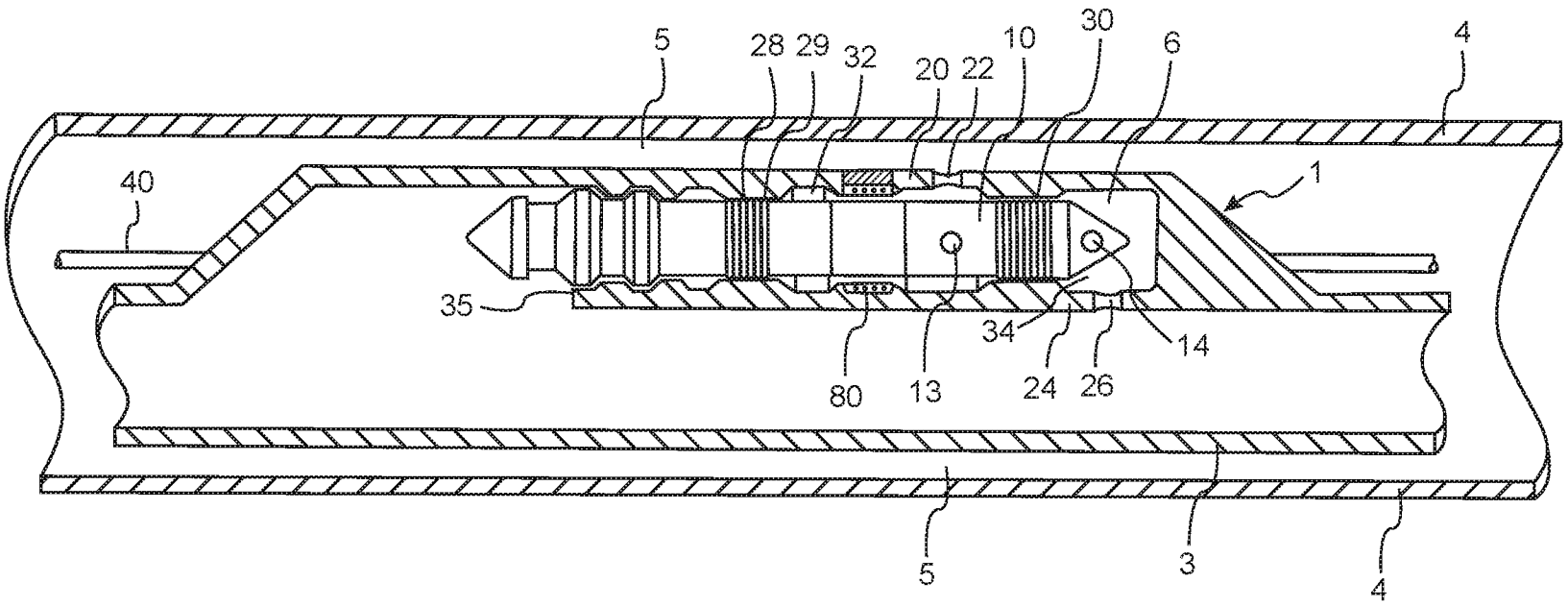
FIG. 2 shows an example of a side pocket mandrel.

An example of a side pocket mandrel 1 is shown in FIG. 2. FIG. 2 illustrates a side pocket mandrel for installation in a production tubing 3 for use in a hydrocarbon well. The side pocket mandrel comprises an interior pocket space 6 and a valve arrangement 10 located in the pocket space for controlling the flow of an injection fluid from an external injection fluid source into the production tubing. The side pocket mandrel 1 also comprises an induction coil arrangement 80 connected to a topside controller 90 and connected to the valve arrangement 10 for transmission of signals from the topside controller to the valve arrangement or vice versa and/or for transfer of electric power from topside controller to the valve arrangement. The connection to the topside controller can be made by cabling 40/41 as schematically illustrated.

The valve arrangement 10 comprises an electrically controlled control valve. The valve arrangement can for example be of the type previously described with reference to FIG. 3.

Figure 4:
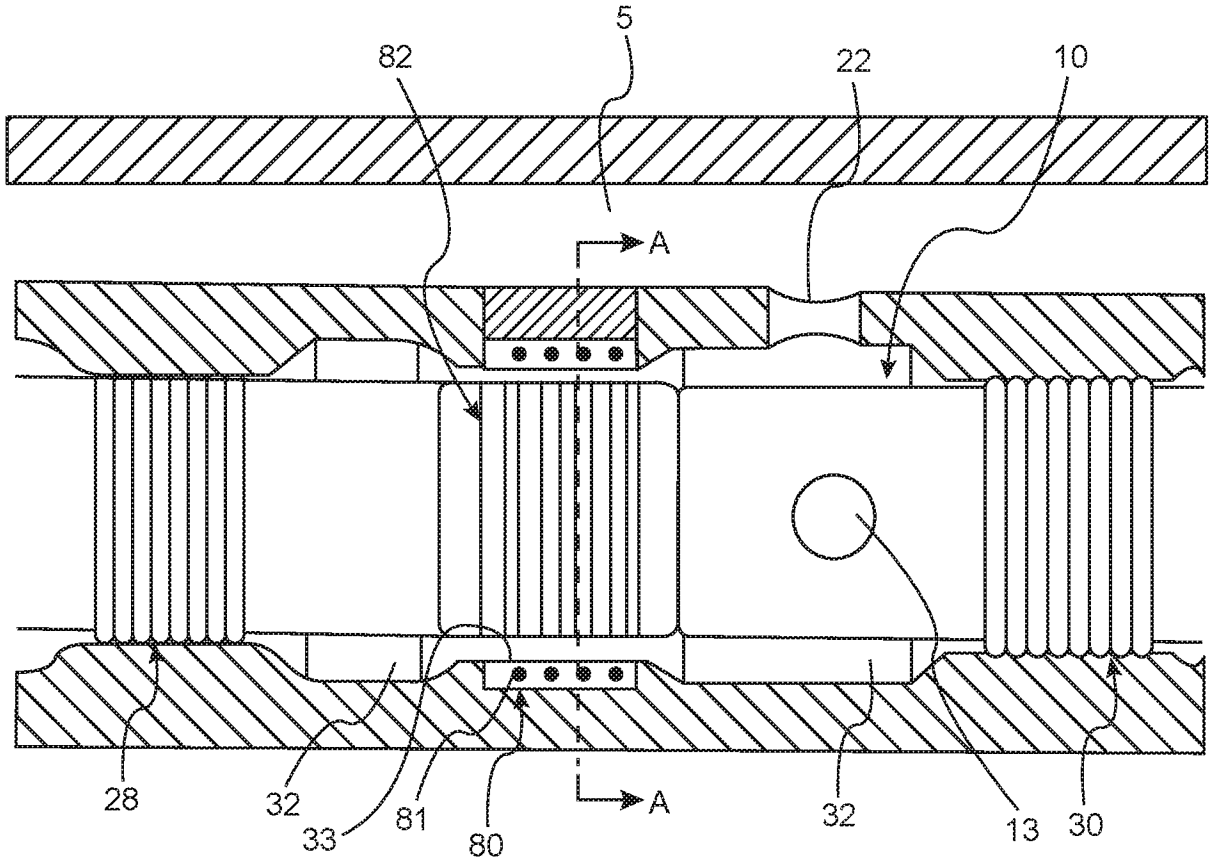
FIG. 4 shows an enlargement of part of the side pocket mandrel in FIG. 2.

According to an example, the induction coil arrangement 80 comprises a first induction coil 81 located at least partly along an interior wall part 33 of the pocket space 6 and a second induction coil 82 located along an exterior part of the valve arrangement 10, and the second induction coil is located inside the first induction coil in a concentric manner. See FIG. 4 and FIG. 5.

In the following is given a general description of a side pocket mandrel 1 and its functions, in order to facilitate the understanding of the following description. Even though the details of the enclosed patent claims are illustrated in connection with the example of a side pocket mandrel shown in FIG. 2 and FIG. 4, the enclosed patent claims should not be interpreted as limited to this example and all its details, but only to the details in the claims. The side pocket mandrel comprises an interior pocket space 6 and a valve arrangement 10, located in the pocket space, for controlling the flow of an injection fluid from an external injection fluid source into the production tubing 3. An inlet port 22 for injection fluid is provided in a first side wall 20 of the side pocket mandrel. The injection fluid can be supplied by a injection line connected at one end to the inlet port and at the other end to the external injection fluid source, which may be located at ground level. This may e.g. the case when the injection fluid is a chemical liquid. Alternatively, the inlet port may simply just provide a fluid connection between the valve arrangement 10 and the annulus 5, as shown in the FIG. 2. The well annulus 5 is the space between the outer protective casing 4 and the production tubing 3. An outlet port 26 for injection fluid is provided in a second side wall 24 of the side pocket mandrel 1 and the outlet port provides a fluid connection between the tubing 3 and the valve arrangement 10. By opening the valve arrangement, injection fluid will flow from the annulus 5, or from a connected injection line, via the valve arrangement 10 and into the tubing 3. A casing string in a well can comprise a number of side pocket mandrels at various locations along the tubing.

Figure 5:
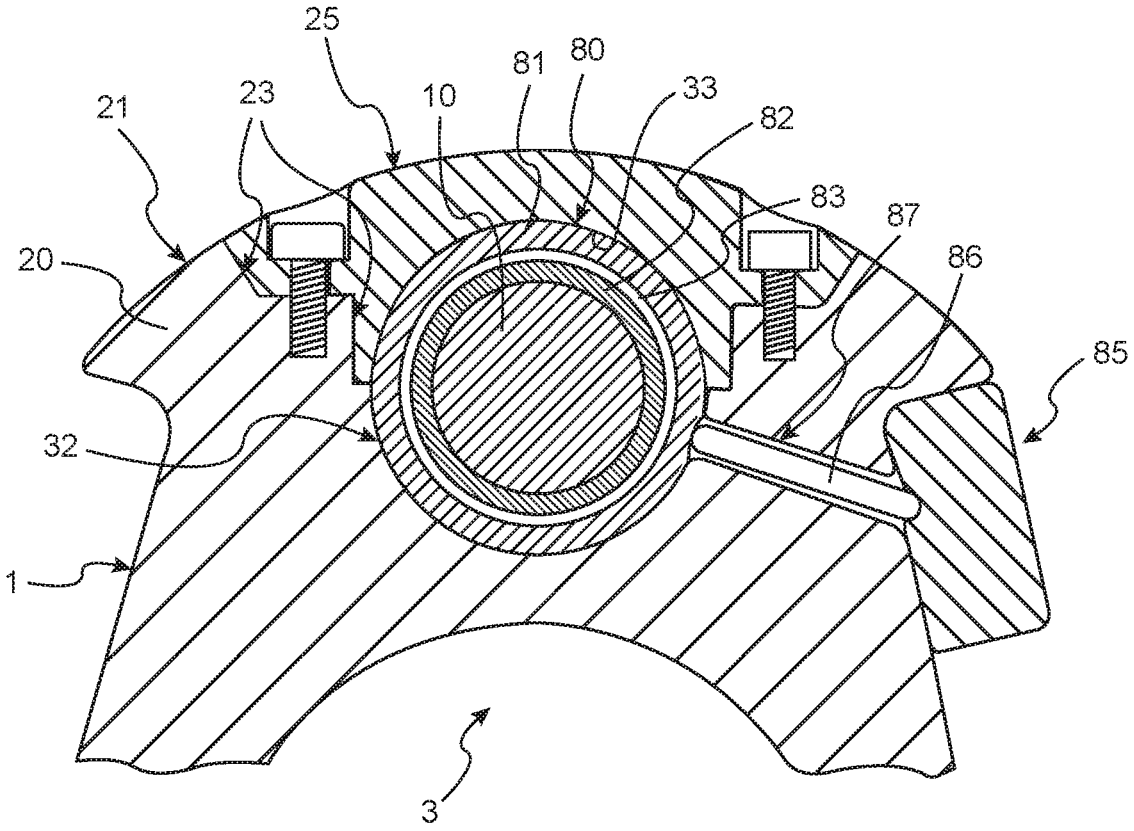
FIG. 5 shows a cross section of part of the side pocket mandrel in FIG. 4, along A-A.

According to an example, the side pocket mandrel 1 comprises a recess 23 provided in an external wall part 21 of the first side wall 20, and the recess reaches down into the first compartment 32. The external wall part is facing the annulus 5. The recess is configured to receive the first induction coil 81 of the induction coil arrangement for insertion into the first compartment 32. It may be mentioned that preferably the first induction coil 81 is put in place in the first compartment 32 before the valve arrangement 10, on which the second induction coil 82 is pre-installed, is inserted into the interior pocket space in the side pocket mandrel. As shown in FIG. 5 there may be a small gap 83 between the induction coils. A lid 25 is provided that is configured to cover the recess 23. The lid also covers the induction coil arrangement located in the recess. The lid would normally be mounted after the first, outer, induction coil 81 has been installed. This would occur when the side pocket mandrel is still on the ground, before it is mounted to the tubing. In the illustrated example, the lid 23 is mounted over the recess by means of screws. However, also other mounting means are of course possible. As mentioned before, the induction coil arrangement can supply electric power to the control system 70, and thereby to the valve arrangement, and also to the power storage device 120 by wireless power transfer between the two induction coils. By varying the frequency or amplitude of an alternating current that is fed to the induction coils, a digital signal can be superimposed on top of the power signal. In relation to FIG. 2 has been mentioned that external electric power to the first induction coil 81 can be supplied via cabling 40/41 connected to a power source. In FIG. 5 is shown an example with an electrical junction box 85 to which the cabling can be connected. The junction box is attached to the outside of the side pocket mandrel. A connection cable 86, leading from the junction box 85 to the first, outer induction coil 81, can be installed in a channel 86 provided in the wall of the side pocket mandrel for this purpose.

In the case when the valve arrangement is used for injection of a chemical liquid delivered by an injection line from surface, the area where the transmitter and receiver are located may have a different pressure to the annulus. In such a case the lid as well as the junction box will need to seal against the side pocket mandrel in order to make a pressure barrier and to prevent any fluid connection between the annulus 5 and the first compartment 32.

As shown in FIG. 2, the pocket space 6 of the side pocket mandrel has an opening 35 through which the valve arrangement 10 can be inserted into the pocket space 6. Many existing side pocket mandrels also has a so called plug hole in its end wall opposite the opening 35. This hole may be used for installing the first, outer, induction coil 81 in the side pocket mandrel, as an alternative to providing a recess and a lid. If there is no such hole, it may also be provided for the purpose of installing the first induction coil.

The side pocket mandrel 1 may further comprise a first seal member 28 located between an internal wall 29 of the pocket space and the valve arrangement, at a first location, and a second seal member 30 located between the internal wall 29 of the pocket space and the valve arrangement at a second location. By this is obtained a first compartment 32 in the pocket space between the first seal member 28 and the second seal member 30.

According to the shown example, the induction coil arrangement 80 is located in the first compartment 32.

The side pocket mandrel may comprise an inlet port 22 for injection fluid provided in a first side wall 20 of the side pocket mandrel, which first side wall 20 is located between the first seal member 28 and the second seal member 30. The inlet port 22 is connectable to the external injection fluid source. The valve arrangement 10 comprises a flow inlet 13 located in the first compartment 32.

The side pocket mandrel may further comprise an outlet port 26 for injection fluid provided in a second side wall 24 of the side pocket mandrel, which second side wall 24 is located in a second compartment 34 of the pocket space 6. The second compartment 34 is separated from the first compartment 32 by one of the seal members 30, and outlet port 26 connects the second compartment 32 with the interior of the well tubing 3. The valve arrangement 10 comprises a flow outlet 14 located in the second compartment 34.

As previously mentioned, the valve arrangement may be a valve arrangement as previously described in relation to FIG. 3, and which is connected to the second induction coil 82 via the control system 70. But also other types of valves are conceivable. The second, inner, induction coil 82 may actually be made part of the valve arrangement. In any case it would be mounted on the valve arrangement before the valve arrangement including the control system, power storage etc., is mounted in the side pocket mandrel. During this mounting, the valve arrangement, including the second, inner, induction coil 82, will be inserted so that the forward part of it will pass through the first, outer, induction coil 81, until the two induction coils are in their respective correct locations in relation to each other. As mentioned, they are located in a concentric manner relative each other. The small gap 83 will facilitate the insertion. The entire valve arrangement, including the second induction coil, can be retrievable from the side pocket mandrel when downhole, such that it would be replaceable by another valve arrangement.

Figure 6:
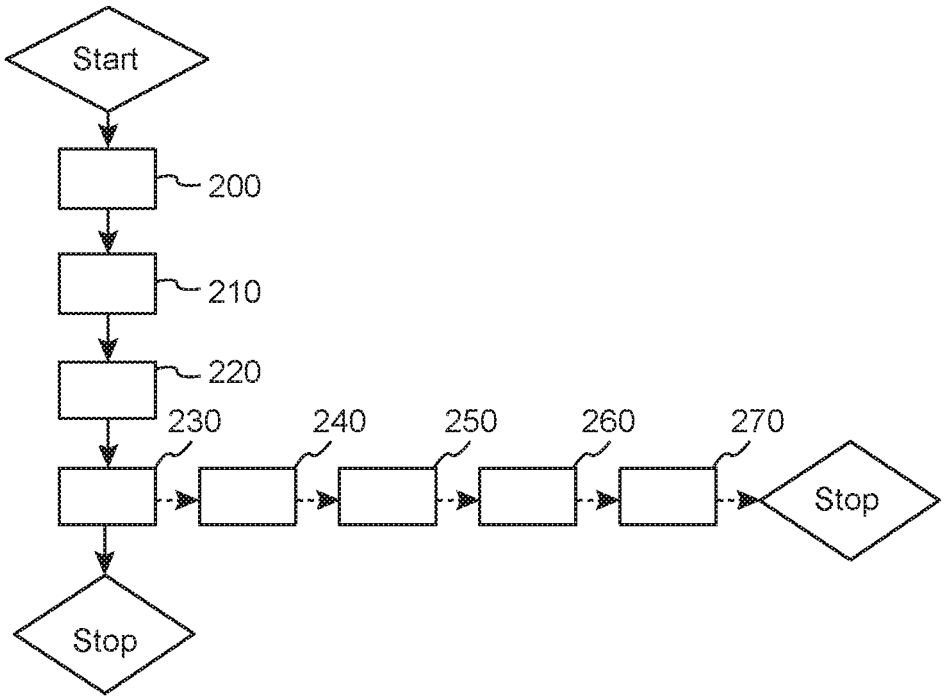
FIG. 6 is a schematic diagram illustrating steps of a first method.

In FIG. 6 is illustrated an example of a first method. The method is a method for operating a downhole valve arrangement 10, installed in a side pocket mandrel 1 forming part of a production tubing 3 of a hydrocarbon well, the valve arrangement comprising an electrically controlled control valve 15 for controlling the flow of an injection fluid from an external injection fluid source into the production tubing 3, and wherein the valve arrangement is connected to a downhole control arrangement 60 comprising an induction coil arrangement 80 comprising two induction coils, comprising steps of

- sending a signal 40 from a topside controller 90, via cabling provided in the annulus, to a first induction coil 81 functioning as a transmitter coil, (200)
- transfer of signal by induction to the second induction coil 82 functioning as a receiver coil, (210)
- transmission of signal 42 via cabling to a control unit 100, (220)

sending a signal 45 from the control unit to an actuator to open the control valve, or alternatively to close the valve. (230)

The method may also comprise sending a valve status signal 51 from the actuator 110 to the control unit 100 confirming that the control valve is open alternatively closed, or using a sensor 130 to check 53 if the control valve is open or closed and send a valve status signal 52 to the control unit, (240) further comprising sending 43 the valve status signal from the control unit 100 to the second induction coil 82 now functioning as a transmitter coil, (250)

transfer of valve status signal by induction to the first induction coil 81 now functioning as a receiver coil, (260)

transmission of valve status signal via cabling 41 to topside controller 90. (270)

Figure 7:
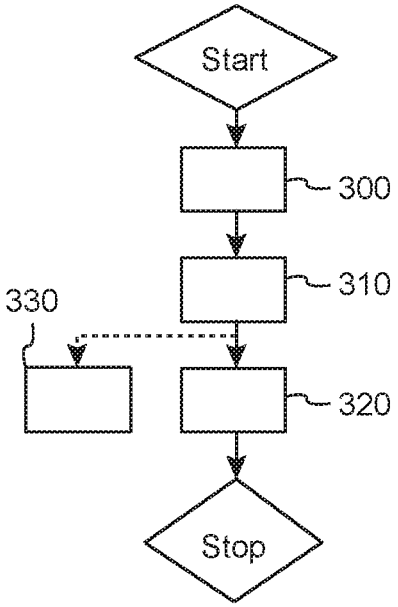
FIG. 7 is a schematic diagram illustrating steps of a second method.

In FIG. 7 is illustrated an example of a second method. The method is a method for supplying electric power to a downhole valve arrangement 10, installed in a side pocket mandrel 1 forming part of a production tubing 3 of a hydrocarbon well, the valve arrangement comprising an electrically controlled control valve 15 for controlling the flow of an injection fluid from an external injection fluid source into the production tubing, and wherein the valve arrangement is connected to a downhole control arrangement 60 comprising an induction coil arrangement 80 comprising two induction coils, comprising steps of transmitting electric power 40 from a topside controller connected to an electric power source, via cabling provided in the annulus, to a first induction coil functioning as a transmitter coil, (300)

transfer of electric power by induction to the second induction coil functioning as a receiver coil, (310)

transmission 42 of electric power via cabling to a control unit 100 that controls an actuator 110 to open 47 the control valve, or alternatively to close the valve. (320)

The control actuator 110 can be supplied with electric power either directly from the induction coil arrangement 80, via cabling 48, or from a power storage device 120 via cabling 46. The control unit 100 may send a signal 44 to the power storage device 120 to supply electric power to the actuator 110.

The method may also comprise using the electric power to charge a power storage device 120 that supplies electric power to the actuator 110. (330) This can be done either directly from the induction coil arrangement 80 via cabling 49 or via the control unit 100.

The control unit will typically comprise signal transmitter, signal receiver, and logical circuitry to provide the different functions. It may e.g. comprise a field programmable gate array, a processor or similar.

The present disclosure shall not be considered limited to the illustrated embodiments, but can be modified and altered in many ways, as realised by a person skilled in the art, without departing from the scope defined in the appended claims.

The invention claimed is:

1. A side pocket mandrel for installation in a production tubing for use in a hydrocarbon well, wherein the side pocket mandrel comprises:

an interior pocket space;

a valve arrangement comprising an electrically controlled control valve and a controller having a processor, the valve arrangement being located in the interior pocket space for controlling the flow of an injection fluid from an external injection fluid source into the production tubing; and an induction coil arrangement connected to a topside controller and connected to the valve arrangement for transmission of signals from the topside controller to the valve arrangement or vice versa and/or for transfer of electric power from the topside controller to the valve arrangement, wherein the valve arrangement comprises an actuator, wherein the induction coil arrangement is configured to send signals from the topside controller to the controller and vice versa, the actuator is configured to move the electrically controlled control valve of the valve arrangement between an open position and a closed position based on the signals, wherein the actuator is configured to send signals to the controller with information about the open/closed status of the electrically controlled control valve, wherein the side pocket mandrel further comprises:

a recess provided in an external wall part of a first side wall, and the recess reaches a first compartment, and the recess is configured to receive a first induction coil of the induction coil arrangement for insertion into the first compartment; and a lid configured to cover the recess.

2. The side pocket mandrel according to claim 1, wherein the induction coil arrangement comprises the first induction coil located at least partly along an interior wall part of the interior pocket space and a second induction coil located along an exterior part of the valve arrangement, and the second induction coil is located inside the first induction coil in a concentric manner.

3. The side pocket mandrel according to claim 1, further comprising:

a first seal member located between an internal wall of the pocket space and the valve arrangement at a first location and a second seal member located between the internal wall of the pocket space and the valve arrangement at a second location, wherein the first compartment is obtained in the pocket space between the first seal member and the second seal member.

4. The side pocket mandrel according to claim 3, further comprising:

an inlet port for injection fluid provided in the first side wall of the side pocket mandrel, wherein the first side wall is located between the first seal member and the second seal member, wherein the inlet port is connectable to the external injection fluid source, and wherein the valve arrangement comprises a flow inlet located in the first compartment, an outlet port for injection fluid provided in a second side wall of the side pocket mandrel, wherein the second side wall is located in a second compartment of the pocket space, wherein the second compartment is separated from the first compartment by one of the first and second seal members, wherein the outlet port connects the second compartment with production tubing, and wherein the valve arrangement comprises a flow outlet located in the second compartment.

5. The side pocket mandrel according to claim 1, wherein the induction coil arrangement is located in the first compartment.

6. A method for operating the valve arrangement, installed in the side pocket mandrel of claim 1, wherein the valve arrangement is connected to a downhole control arrangement comprising the induction coil arrangement comprising the first induction coil and a second induction coil, the method comprising:

sending a signal from the topside controller, via cabling provided in an annulus, to the first induction coil functioning as a transmitter coil, transmitting a signal by induction to the second induction coil functioning as a receiver coil, transmitting a signal via cabling to the controller, sending a signal from the controller to the actuator to open the electrically controlled control valve, or alternatively to close the electrically controlled control valve, sending a valve status signal from the actuator to the controller with information about the open/closed status of the electrically controlled control valve.

7. The method of claim 6, comprising:

sending a valve status signal from the actuator to the controller confirming that the electrically controlled control valve is open or closed, or using a sensor to check if the electrically controlled control valve is open or closed and send a valve status signal to the controller, sending the valve status signal from the controller to the second induction coil now functioning as the transmitter coil, transmitting the valve status signal by induction to the first induction coil now functioning as the receiver coil, transmitting the valve status signal via cabling to the topside controller.

* * * * *